United States Patent [19]

Davis

[11] 4,121,404

[45] Oct. 24, 1978

[54] APPARATUS FOR APPLYING FOIL COVERS FOR TRAYS

[76] Inventor: Raymond A. Davis, 1150 Chula Vista, Belmont, Calif. 94002

[21] Appl. No.: 870,461

[22] Filed: Jan. 18, 1978

Related U.S. Application Data

[63] Continuation-in-part of Ser. No. 718,465, Aug. 30, 1976, abandoned.

[51] Int. Cl.[2] ..... B65B 7/28

[52] U.S. Cl. ..... 53/329; 53/344; 53/389

[58] Field of Search ..... 53/296, 297, 298, 329, 53/341, 348, 354, 389, 42, 344, 306

[56] References Cited

U.S. PATENT DOCUMENTS

| | | | |
|---|---|---|---|
| Re. 13,851 | 12/1914 | Brinkman | 53/348 X |
| 2,920,431 | 1/1960 | Izumi | 53/141 |
| 2,928,222 | 3/1960 | Lindstaedt | 53/297 |
| 3,036,416 | 5/1962 | Cheeley et al. | 53/354 X |
| 3,048,954 | 8/1962 | Abel | 53/329 |
| 3,193,978 | 7/1965 | Bader | 53/42 X |
| 3,440,795 | 4/1969 | Grant | 53/42 |
| 3,619,972 | 11/1971 | Pringle et al. | 53/329 X |
| 3,708,954 | 1/1973 | Wilke et al. | 53/329 |
| 3,712,021 | 1/1973 | Logemann et al. | 53/329 |
| 3,800,502 | 4/1974 | Vermeulen | 53/329 |
| 3,834,120 | 9/1974 | DeFaccio et al. | 53/389 X |
| 3,866,387 | 2/1975 | Davis | 53/329 X |

*Primary Examiner*—Horace M. Culver
*Attorney, Agent, or Firm*—Julian Caplan

[57] ABSTRACT

A machine to cover filled, preformed trays of a wide variety of shapes or sizes with foil or other material which will remain folded, from rollstock. The machine is simple, with few change parts, rapidly changed. To be truly rotary enabling high speeds. To have the cover stock continuously feeding trays travelling as close together as the overlying foil will permit, the trays travelling horizontally with no sideways movement. The foil to be folded down and under in one continuous movement exactly to the outside shape of the tray's lip, with no distortion of the foil atop the tray and with the foil so well crimped that there is no possibility of liquid leakage. The machine to be either equipped with its own conveyor, or capable of being placed over an existing conveyor.

17 Claims, 20 Drawing Figures

POSITION 1 [9]

POSITION 2 [8]

POSITION 3 [7]

POSITION 4 [6]

POSITION 5

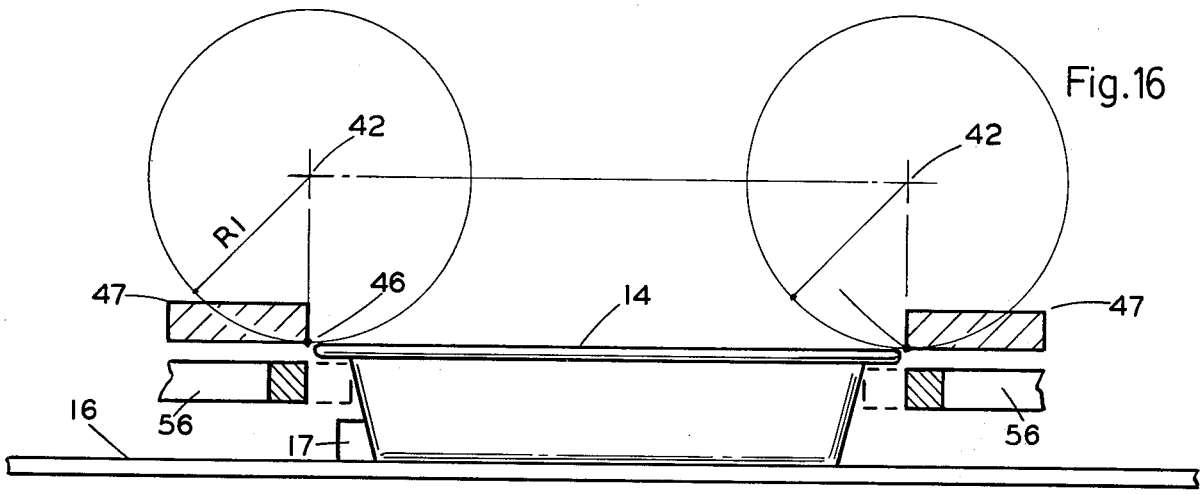
Fig.16
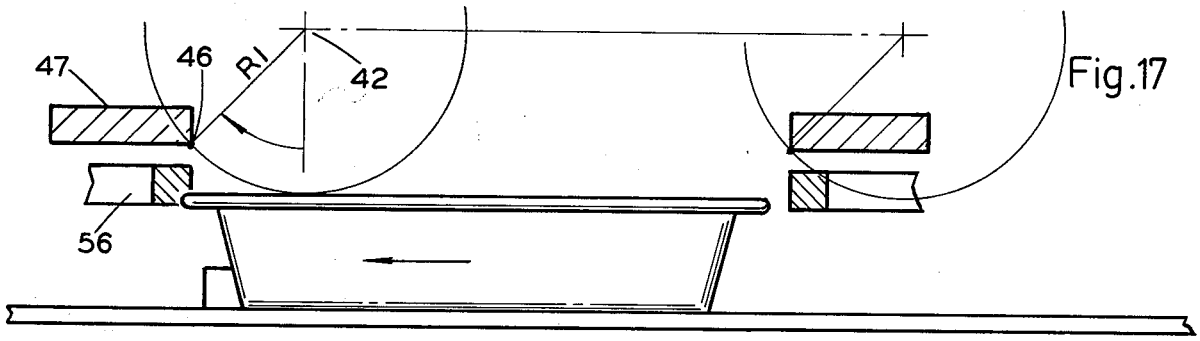
Fig.17
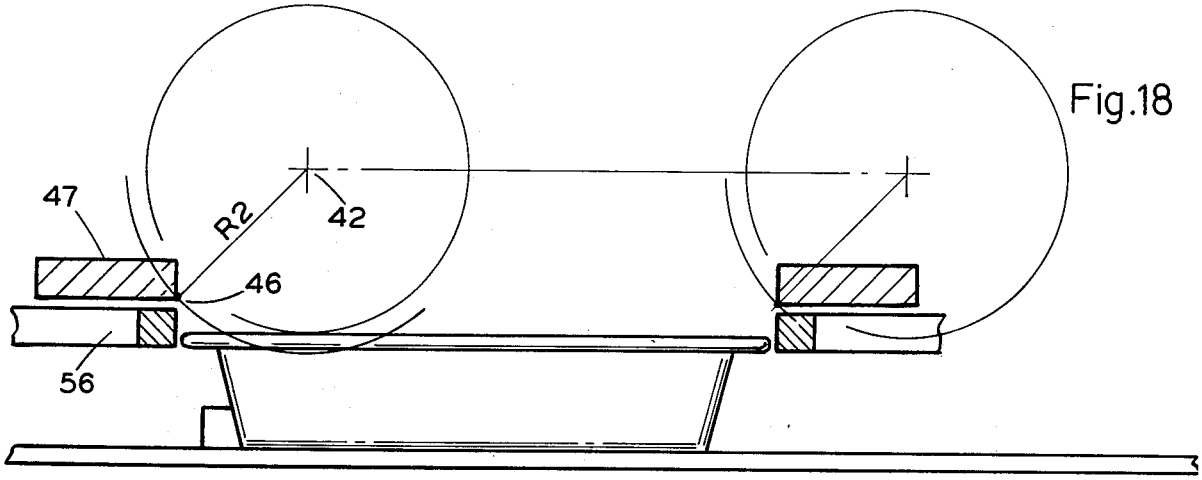
Fig.18
Fig.19
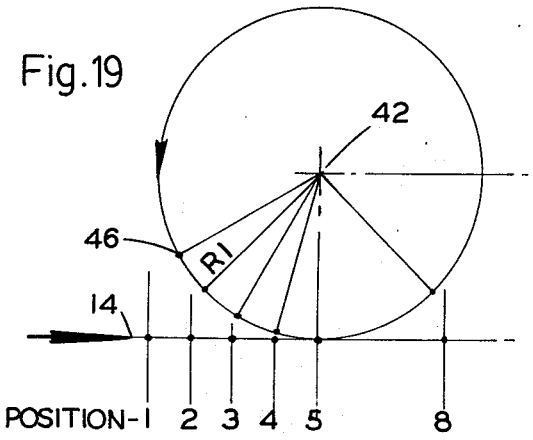
Fig.20
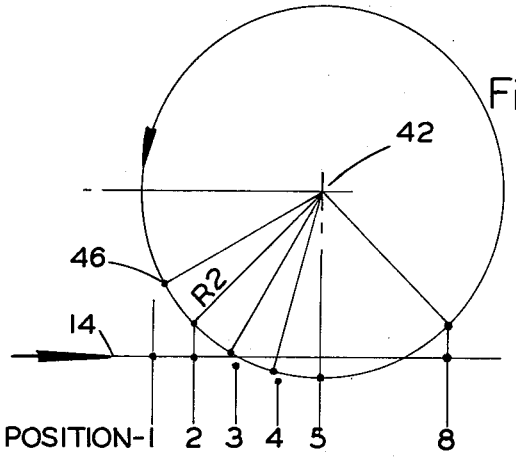

APPARATUS FOR APPLYING FOIL COVERS FOR TRAYS

SUMMARY

This invention relates to a new and improved apparatus which feeds a continuous web of metal foil or other material which will remain folded and cuts it continuously into lengths slightly greater than preformed trays of the type used for packaging frozen food and the like. As the trays move along a conveyor the forward lip of the tray strikes the downward moving leading edge of the foil pushing the foil forward. The forward corners of the foil strike stationary blocks which cause the foil to tuck under the tray corners and be pinched firmly to enable the tray and foil to advance together.

A carrier plate rotates above the trays, once per tray. Attached under the plate, and at each corner of it, are four bars which together are the shape of the body of the tray under the lip. These folder bars are arranged slightly outward from the tray lip. As the plate with folders is rotated downwards towards the foil-covered tray and the folders contact the foil, they push it downwards somewhat vertically all around the tray lip. After the folders have passed below the tray lip they are caused to move diagonally inward under the entire lip. This movement is completed at bottom dead center, the foil is now firmly crimped against the tray's body under the lip, all around. Because of this continuous movement the foil is now taut and well crimped, completely following the contours of the tray. As the carrier plate and folders continue their rotation the folders retract exactly as they came in, so that they are fully retracted as they clear the tray. The only independent movement of the folders is a horizontal in and out under the tray lip.

Of the faster continuous machines heretofore sold, many require several mechanisms along the conveyor to fold various portions of the tray. All are large and expensive with many change parts, requiring a long changeover time from one tray to another. None is operable without its own conveyor. Many have the tray changing direction, causing food spillage.

A major advantage of the design of the present invention over others which attempt rotary folding is that the trays are placed as close together as the unfolded foil can abut. By changing the cranks this condition can be achieved with any length of tray, one revolution of the cranks applying one foil to one tray. In, for instance, Logemann U.S. Pat. No. 3,712,021 where horizontal and vertical motions are combined to produce elongated rotary motion, the trays are always widely spaced because the folder must follow the tray down the conveyor and then return to the next tray.

In the present invention the size or shape of the tray handled requires merely removing a few simple fasteners to change parts. Because of the products handled and the number of personnel on a line, rapid changeover of tray sizes is always required.

Other objects of the present invention will become apparent upon reading the following specification and referring to the accompanying drawings in which similar characters of reference represent corresponding parts in each of the several views.

In the drawings

Figure 1:
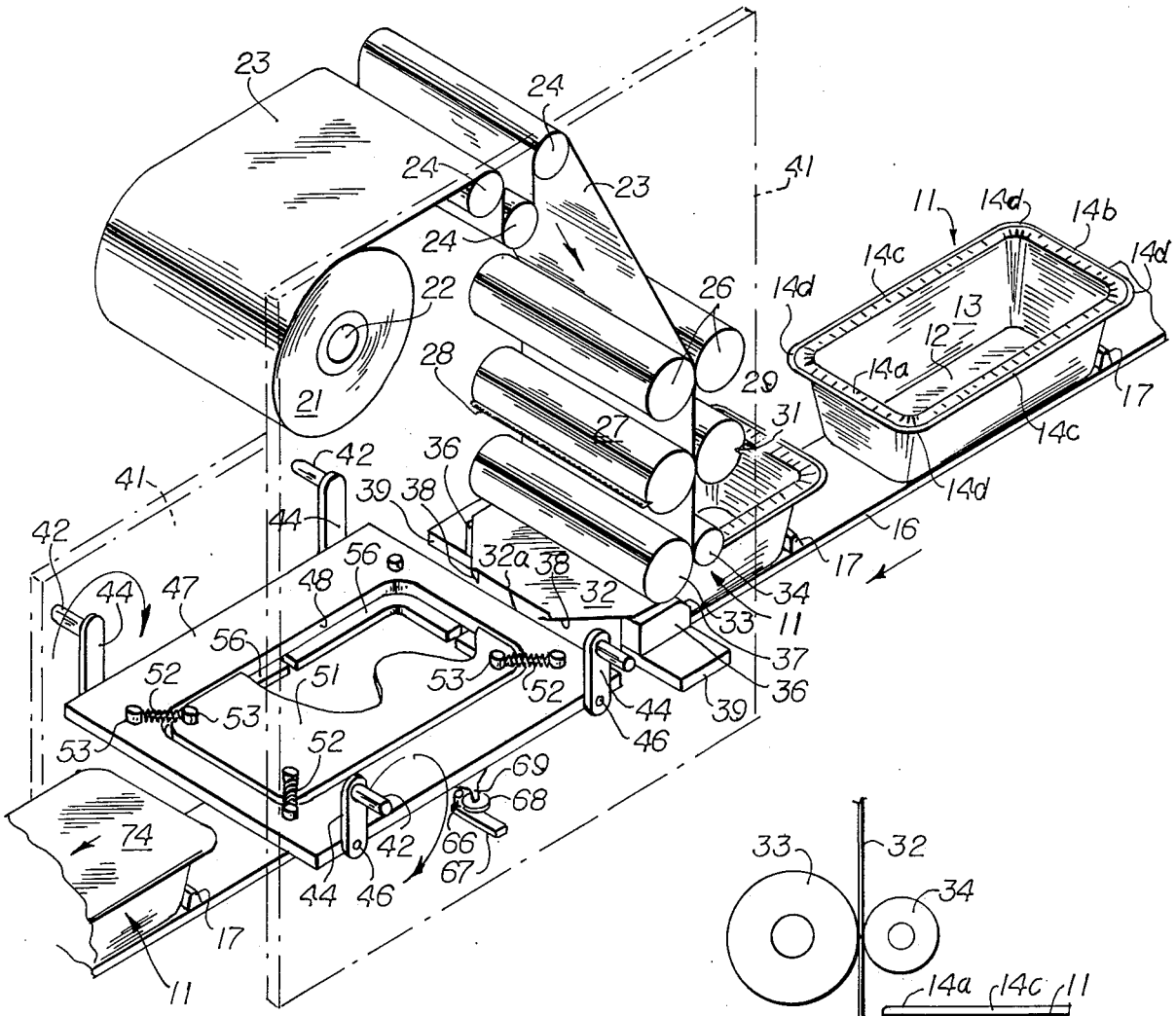
FIG. 1 is a somewhat schematic perspective view of the invention installed on a conveyor line.

FIGS. 16, 17, 18, 19 and 20 explain how the folders can follow a rotary path while remaining in vertical relationship with the tray lip.

Tray 11 shown in the accompanying drawings is subject to considerable variation in size and shape. It is usually formed of a fabricated heavy metal foil and is generally of the type used to pack frozen food. The example shown is provided with a flat bottom 12, upwardly-outwardly slanting sides 13 and a peripheral lip 14 which is separate designated in the accompanying drawings as having a leading edge **14*a*, a rear edge 14*b*, side edges 14*c* and rounded corners 14*d*. Although shown empty, it will be understood that the tray 11 is filled with foodstuffs or other material, generally frozen after wrapping by the present apparatus. A conveyor 16 here shown as being a continuous belt is provided at intervals with lugs 17 extending transversely and engaging the rearward end of tray 11 so that the movement of the tray is in accurately timed and spaced relation. Lugs 17**, may also be placed at the forward end if required.

The wrapping of the present invention is provided from a roll 21 of metal foil or other material which will remain in folded condition after passing through the apparatus. Roll 21 is supported on a mandrel 22. The mandrel 22 as well as the rolls which are hereinafter described are rotatably mounted relative to plates 41 (shown in FIG. 5 and schematically in FIG. 1) on opposite sides of the apparatus and certain of the rolls are driven in timed relation to the movement of the conveyor 16 and the spacing between lugs 17. Further, the length of tray 11 is accomodated by replacing plate 47 and its folding mchanism and occasionally cranks 44. Adjusting to width will readily occur to one skilled in the art to which this invention pertains but is not here shown in detail.

A web 23 of foil material of proper width for the tray being wrapped is threaded around dancer rolls 24 of well-known construction which maintain a tension on web 23. A pair of web feed rolls 26 rolls the foil in timed relation to the speed of conveyor 16. At a proper distance above the level of conveyor 16 are first and second shear rolls 27, 29 provided with a radial knife 28 and a slot 31, respectively, to shear off a sheet 32 of foil.

Figure 2:
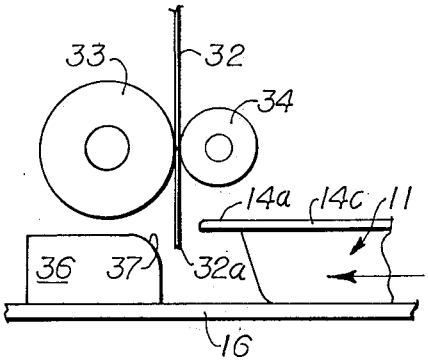
FIG. 2 is a somewhat schematic side elevational view showing the first stage in the wrapping of a sheet of foil to the leading edge of a tray.
Figure 3:
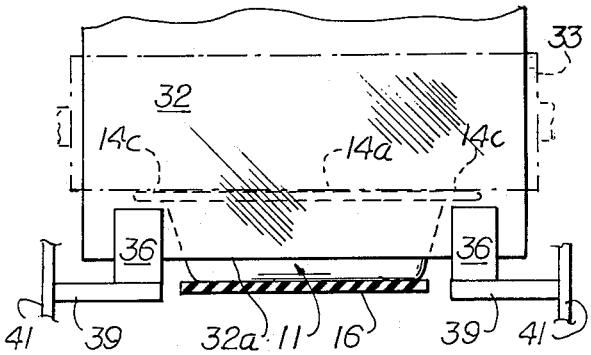
FIG. 3 is an end elevational view of the structure of FIG. 2 with certain parts removed.
Figure 4:
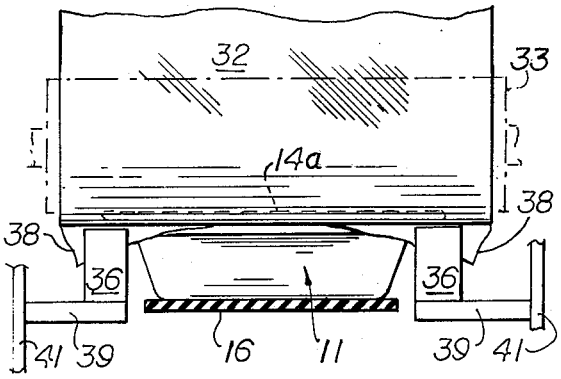
FIG. 4 is a view similar to FIG. 3 showing a further stage in the cycle of movement of the tray.

Each sheet 32 passes between sheet feed roll 33 and backup roll 34. As each tray 11 approaches the rolls 33, 34, the leading edge 32a of sheet 32 is vertically positioned immediately above the conveyor 16 so that it is engaged by the leading edge 14a of the next approaching tray 11. On either side of conveyor 16 is a block 36 having a curved rearward edge 37 and stationarily mounted by means of support 39 to the side frames 41 of the machine (see FIG. 3). Directing attention to FIG. 2, as the leading edge **14*a* contacts the sheet 32, it moves it to the left in the position as shown in FIG. 2; or, as shown in FIG. 3, towards the observer. Since the edges 14c project out over the blocks 36, the corners 38 of sheet 36 are folded backward and the center of the lower edge 32*a* of sheet 32 is left parallel with tray lip 14, all as shown in FIG. 4. This assures that the sheet 32 will move with the tray 11; and as it moves, the sheet 32 overlies the top of tray 11**.

Figure 5:
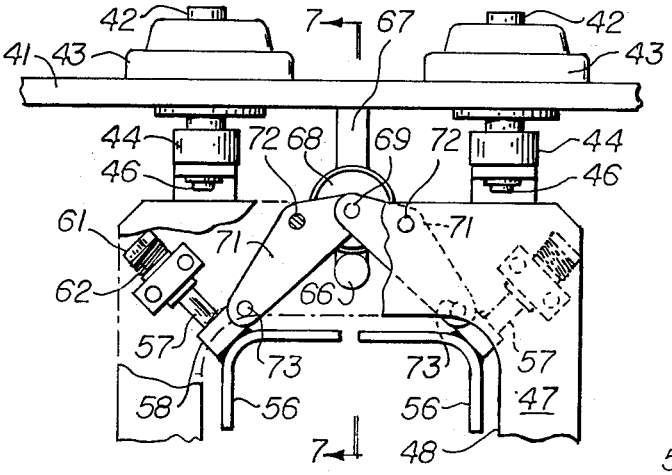
FIG. 5 is a plan view of a portion of the structure of FIG. 1.
Figure 7:
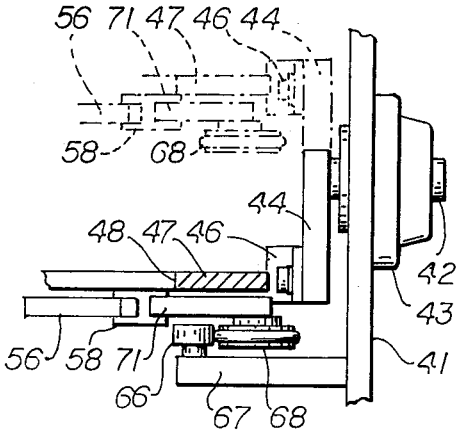
FIG. 7 is a fragmentary sectional view taken substantially along line 7—7 of FIG. 5 showing in solid lines the parts in the position of FIG. 5 and is dot-and-dash lines the parts in the position of FIG. 6.
Figure 6:
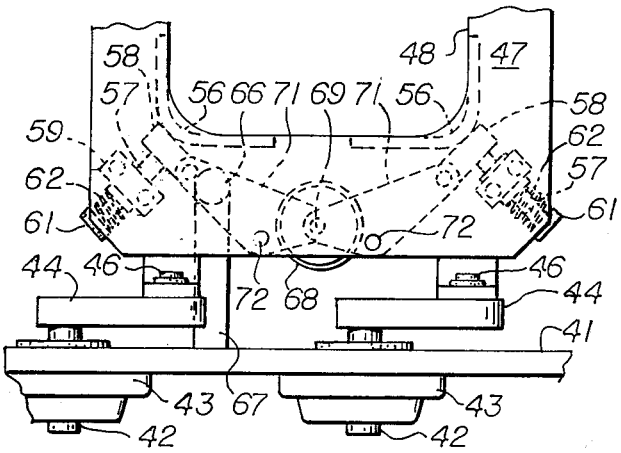
FIG. 6 is a plan view of another portion of the structure of FIG. 1 showing the apparatus at a different stage in the cycle of operation than shown in FIG. 5.

Immediately beyond the rolls 33, 34 in the direction of movement of conveyor 16 is the foil crimping station, a change part of the machine, which is partially shown in FIG. 1 and is shown in detail in FIGS. 5–7. On each side of the conveyor 16 is a vertical side frame plate 41. Rotatable in plates 41 are four shafts 42 mounted in bearings 43 attached to plates 41 and driven in unison by means not shown but well understood by one skilled in the machinery arts. On the inside of plates 41 for each shaft 42 is a crank 44 having a length appropriate for the distance between the leading edges of trays 11. These cranks 44 are also change parts of the machines. The ends of cranks 44 are connected by pins 46 to the corners of a plate 47 formed with a central aperture 48 slightly larger than the tray 11. The rotation of shafts 42 causes plate 47 to pass through a cycle of movement in timed relation to the advance of the conveyer 16. This cycle is hereinafter described. The length of cranks 44 and the speed of rotation of the shafts 42 are a function of the distance between trays, the length of tray 11 and the speed of the conveyor 16.

A small plate 51 slightly smaller than the aperture 48 is spring mounted at the level of plate 47 by means of spring 52 at each corner. The opposite ends of springs 52 are attached to plate 46 and plate 51 by means of anchors 53. The function of the small plate 51 is to flatten any material filling the tray 11 and also to prevent the tray remaining within aperture 48 after the crimping of cover 74.

Mounted slightly below the level of plate 47 at each of the four corners of the aperture 48 are bars 56 which move diagonally inwardly and outwardly. For the rectangular trays 11 shown, the bars 56 are L-shaped and four in number and there is one bar 56 at each corner of aperture 48. For trays of other shapes (e.g. round or elliptical) the bars are shaped accordingly. Diagonal reciprocable horizontal rods 57 are attached to each bar 56 by a connector 58 and are mounted for reciprocation in bearings 59 attached to the underside of plate 47. Each rod 57 has an enlarged head 61 at its outer end and between head 61 and bearing 59 is a coiled spring 62 which biases the rods 57 and the bars 56 outwardly toward the position shown in dot-and-dash lines in FIG. 6 and away from the projected position shown in FIG. 5. Reciprocation of bars 56 may be accomplished in various manners as hereinafter described. No matter how they are moved, when they project inwardly they meet approximately at the center of each end and each side of tray 11, tucking the foil sheet 32 under the lip 14 to provide the wrapping 74, as best shown in FIGS. 11–15. After the foil has been tucked under the lip, the spring 62 causes the bars 56 to retract to outer position. It will be noted that the movement of the bars 56 is diagonally inwardly from each corner **14*b* of the tray 11**.

In the form of the invention shown in FIGS. 5–7, the bars 56 are mechanically moved. Thus there is a stationary roller 66 mounted above the level of conveyor 16 near the outer edge of plate 47. Support 67 fixes the roller 66 to frame members 41. A larger roller 68 is carried by each outer side of plate 47 and is preferably rubber covered so that its contact with roller 66 is cushioned. Roller 68 is mounted on a vertical shaft 69 which moves inward and outward relative to plate 47. Outward movement of shaft 69 is caused by roller 68 contacting the stationary roller 66 as the plate 47 moves past the roller 66. Pinned for oscillatory movement on the underside of plate 47 are a pair of bell cranks 71. Pins 72 pin the cranks 71 to the plate 47. The crossed outer ends of the cranks 71 are mounted on shaft 69. The inner ends of the cranks 71 are pivoted by means of pivots 73 to the connectors 58. When the roller 68 is out of contact with the roller 66, as is shown in FIG. 6, the springs 62 cause the bars 56 to retract. When the roller 68 contacts roller 66, the shaft 69 moves outward to permit passage of roller 68 past roller 66 and this causes the ball cranks 71 to move from the position of FIG. 6 to the position of FIG. 5 which, in turn, moves the bars 56 from the retracted position of FIG. 6 to the projected position of FIG. 5, causing the bars 56 to tuck the foil under the lip 14.

As viewed in FIG. 7, the position of the plate 47 is shown in elevated position in dot-and-dash lines. The plate 47 moves from the elevated position downward to the solid line position of FIG. 7 and the roller 68 moves from a position immediately under the dotted line position of FIG. 7 to the outer solid line position at the bottom of FIG. 7 because of contact of roller 68 with stationary roller 66.

Figure 8:
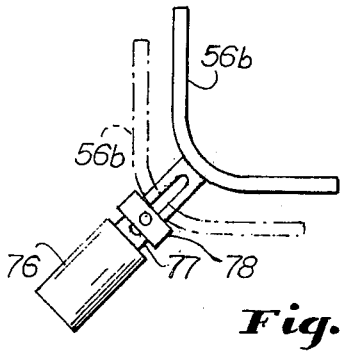
FIG. 8 is a fragmentary plan view of a modification.

An alternate means of causing the bars **56*b* to be moved diagonally inward to tuck the foil under the lip of the tray is shown schematically in FIG. 8. Thus a pneumatic or hydraulic cylinder 76 or an electric solenoid has its ram 77 passing through guide 78 and attached to the corner of the bar 56*b*. As the tray moves into position and the plate 47 moves past a stationary roller 66 (not shown in FIG. 8), a valve or switch carried by plate 47*b* is contacted causing actuation of the cylinder or solenoid 76 and causing the movement of the bar 56*b* diagonally inward from the dot-and-dash position of FIG. 8** to the solid line position.

Figure 11:
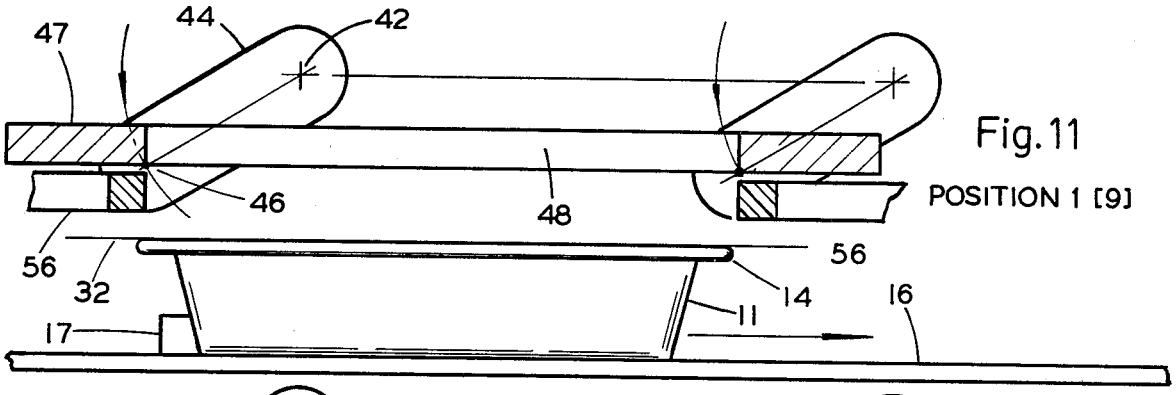
FIGS. 11, 12, 13, 14 and 15 are schematic views showing positions of a tray moving on a conveyor and the foil folding means at various positions in the cycle of operation of the machine.
Figure 12:
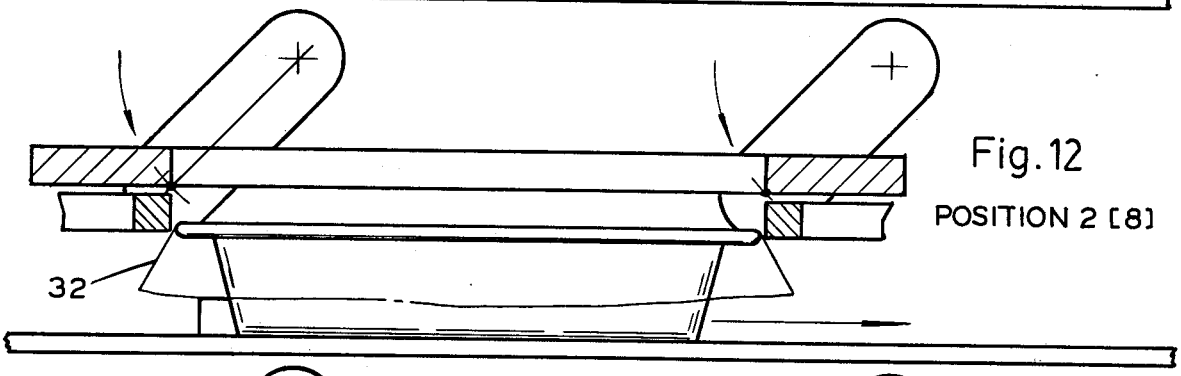
Figure 13:
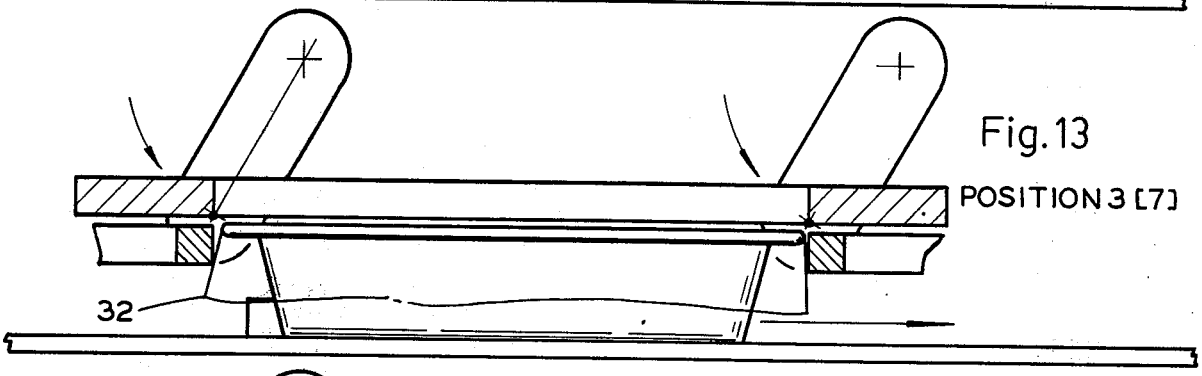
Figure 14:
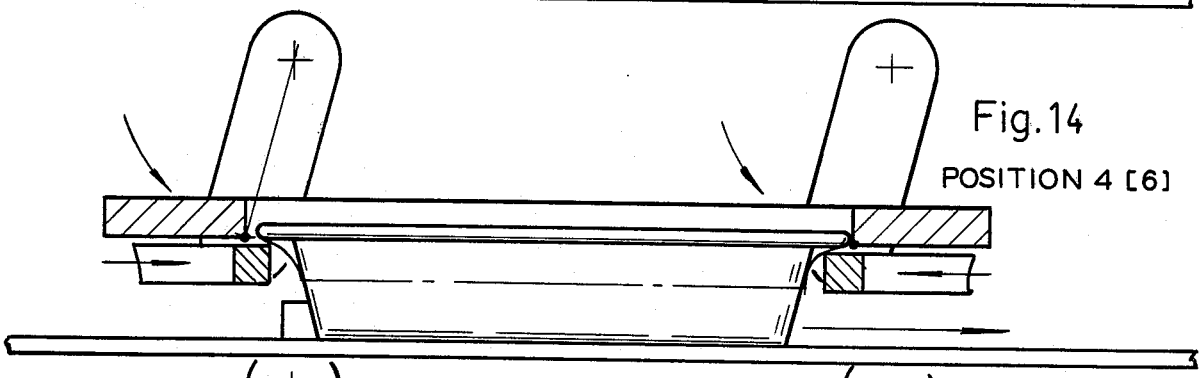
Figure 15:
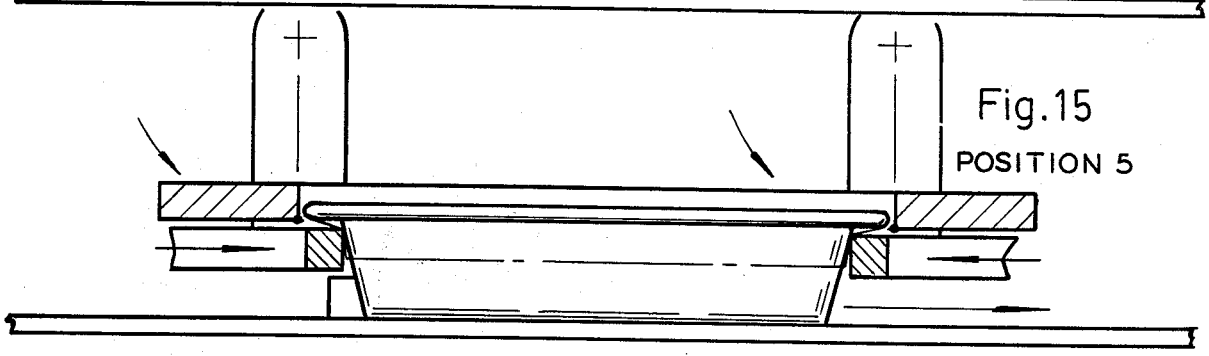

Directing attention now to FIGS. 11–15 which show the path of the folders in nine equally-spaced positions. The cranks 44 continuously rotate around axes 42. The cranks being connected to plate 47 by hinge pins 46 cause the plate to rotate horizontally over the tray. The folders 56 attached to the plate follow the same circular path. In FIG. 11 this mechanism is rotating towards the tray. The tray has the foil folded around its forward corners but this is not shown. In FIG. 12 the tray has advanced and the folder bars 56 have pushed the foil down slightly all around the tray lip. The tray is centered between the folders. In FIG. 13 the foil is pushed further down, the tray is slightly off center but this is unimportant as the folders have now almost passed the tray lip. In FIG. 14 the folders are lower than the lip and the action shown in FIGS. 5 and 7 has begun. As roller 68 rotates about stationary roller 66 the folders 56 have begun to move inwards, again with slight misalignment of the tray with the folders. In FIG. 15 the folders are fully extended as a FIG. 5 and the tray is perfectly aligned with the folders enabling an even crimp around the complete tray. The motion continues in an exact reversal of FIGS. 15–11, or positions 5–9, leaving the foil fully crimped and clearing the tray at FIG. 12, position 8, with the tray aligned in the folders. In FIG. 16 it will be obvious that when a circle of radius R1 is to remain in timed contact with a horizontally moving line 14 they will only be aligned at one point on the lower semicircle, in this case, bottom dead center. This is the point at which the folders must be in line with the tray in order to provide a perfect crimp beneath the tray's lip. When the machine is backed up as in FIG. 17, it will be seen that the folders 56 and the tray lip 14, collide. Conversely, on leaving the tray, the folders would remain beneath the lip. For good, even folding the folder bars must be aligned with the tray on passing over the tray FIG. 12, again at bottom dead center FIG. 15 when crimping, and again at FIG. 12 position 8.

This is accomplished by designing in the following way: The hinge point instead of being placed in its natural place as in FIGS. 16 and 17 is extended. A tray position is chosen at which the initial fold is desired and the folders placed around it to clear exactly. The radius of crank arm 44 is extended from R1 to R2 (see FIGS. 19 and 20) and the folders raised slightly to provide a tighter crimp. It will be seen that at entrance (position 2), final folding at position 5, and on leaving the tray, position 8, the folders 56 are perfectly aligned with the tray, with absolutely minimum clearances required on entering and leaving, insuring a perfect fold all around conforming to the tray shape. The slight misalignment between folding down and folding inwards is unimportant as full contact is only made at bottom dead center. There is no rolling contact with the top of the tray, so that even if lugs 17 are placed at each end of the tray there will be no disturbance of the foil.

FIG. 19 shows the natural vertical relationships between a point on the line of the tray top and one on a circle (radius R1) which are travelling together. If folding was attempted during the small segment which is almost in line, the maximum time available would be about 20° each side of position 5.

FIG. 20 shows the same tray relationships with the extended radius R2 used in the example, in this case the fold range is extended to 45° each side of position 5, and with exact alignment.

Figure 9:
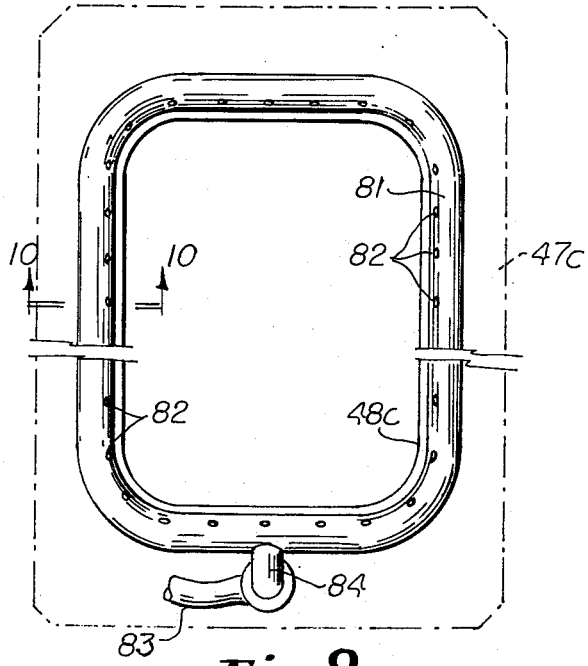
FIG. 9 is a plan view similar to FIG. 5 of a further modification.
Figure 10:
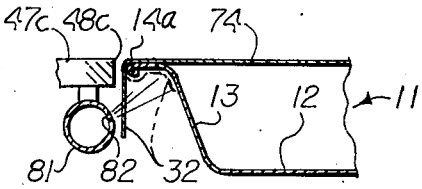
FIG. 10 is a sectional view taken substantially along the line 10—10 of FIG. 9.

FIGS. 9 and 10 show still another means for tucking the foil under the tray which is useful particularly in high speed installations. Thus surrounding the aperture 48*c* of plate 47*c* and immediately below and outside said aperture is a tube 81. This tube replaces folder bars 56 and pushes the foil down around the tray lip as in FIGS. 11–13, and is hinged as in FIG. 18. However, once past the lip, inward folding is accomplished by having a plurality of spaced openings 82 through which compressed air in tube 81 escapes causing the air to blow the foil from the solid line position of FIG. 10 to the dotted line position. A flexible tube 83 connected to a source of air under pressure extends from the top of the machine downwardly to a connector 84 which communicates with tube 81. The flexible tube 83 permits the plate 47*c* to move with the conveyor. In timed relation to the movement of the plate 47*c*, a valve (not shown) permits compressed air to flow through tube 83, connector 84 and tube 81. As is shown in FIG. 10, air escaping through the openings 82 blows the edges of the foil from the solid line position of FIG. 10 to the dotted line position where it is tucked under the lip 14*a*. The modification of FIGS. 9 and 10 is particularly useful where rapid movement of conveyor 16 is required.

Many of the elements of the modification of FIG. 8 and of FIGS. 9–10 are not shown since they will be well understood by those skilled in the art. Corresponding parts of the two modifications are shown with the same reference numerals as in the preceding modification followed by the subscripts *b* and *c*, respectively.

What is claimed is:

1. Apparatus for wrapping a sheet of foil positioned on top of a tray, under the peripheral lip of said tray comprising a conveyor, first means for advancing said tray horizontally at a continuous rate, second means, third means for mounting and supporting said second means, said third means comprising a first and second crank, said cranks being of equal length, fourth means for continuously rotating said cranks in unision about first and second axes, respectively, said axes being equal distances above and transverse to said conveyor and spaced apart longitudinally relative to said conveyor, said second means being moved by said third means in a rotary path, said path including a first position above said tray and conveyor, said second means being disposed above and spaced outward relative to the edges of said lip, then below to a second position and spaced from said first position in the direction of movement of said conveyor, continuing to a third position, then to a fourth position wherein said second means passes around the tray lip, then to a fifth position with said cranks being vertically downward, said second means being around the lip of the tray and spaced outward relative to said lip at said fifth position, then to sixth, seventh, eighth and ninth positions at the same levels above the conveyor as said fourth, third, second and first positions respectively, fifth means on said second means positioned at a fixed distance from said axes to engage said sheet and fold said sheet somewhat vertically downward below said lip all around the periphery of said lip as said second means moves from first to third positions, sixth means for actuating said fifth means to move said downward-folded foil inward under said lip all around the periphery of said lip as said second means moves between third and fifth positions and then to retract said fifth means as said second means moves from fifth to seventh position.

2. Apparatus according to claim 1 in which said second means comprises a plate formed with an aperture and which further comprises a sconed plate smaller than said aperture located at the level of said first-mentioned plate and resilient means connecting said plates together so that said second plate may float relative to said first-mentioned plate and bias said second plate toward said tray to compress said foil against the contents of said tray and to bias said tray out of said aperture as said plate moves from fifth to seventh positions.

3. Apparatus according to claim 1 in which said second means comprises a plate formed with an aperture and in which said aperture is generally rectangular and said fifth means are movable diagonally inward from each corner of said aperture.

4. Apparatus according to claim 3 in which said fifth means comprises horizontally disposed folder bars, shaped to a quarter of the tray body beneath the lip positioned slightly below said plate.

5. Apparatus according to claim 4 in which said sixth means comprises an electric solenoid.

6. Apparatus according to claim 4 in which said sixth means comprises a fluid-actuated cylinder.

7. Apparatus according to claim 1 in which said fifth means comprises a tube supported by and spaced below said second means, folding foil somewhat vertically downward at said second and third positions, having a plurality of holes directed inward relative to said tray and said sixth means comprises means for blowing air under pressure into said tube and out through said holes at position 5.

8. Apparatus according to claim 1 which further comprises sheet feed means for feeding a sheet of foil from a location above said conveyor hanging verticaly toward said conveyor with the leading edge of said sheet positioned below the leading edge of the lip of one said tray as said tray advances along said conveyor, a pair of stationary blocks on opposite edges of said conveyor positioned to engage said leading edge of said sheet to turn said sheet to horizontal position and crimp the corners of said sheet partially inward under the corners of the leading edge of said lip, whereby said sheet advances with said tray and is held against sliding off said tray and overlies said tray as it advances on said conveyor to a position underlying said second means.

9. Apparatus according to claim 8 which further comprises web feed means for feeding a web of foil from a mandrel toward said sheet feed means, and shear means between said web feed means and said sheet feed means to shear off a sheet of foil of a length greater than the length of said tray.

10. Apparatus according to claim 8 in which said sheet feed means comprises a pair of rollers turned in timed relation to movement of said conveyor.

11. Apparatus for feeding foil for subsequent use in wrapping a tray movable along a continuous conveyor, said tray being of the type having a circumferential peripheral lip comprising sheet feed means for feeding a sheet of foil from a location above said conveyor hanging vertically toward said conveyor with the leading edge of said sheet positioned below the leading edge of the lip of one said tray as said tray advances along said conveyor, a pair of stationary blocks on opposite edges of said conveyor positioned to engage said leading edge of said sheet to turn said sheet to horizontal position and bend the lowermost two corners of said sheet partially inward under the corners of the leading edge of said lip, whereby said sheet advances with said tray and is held against sliding off said tray and overlies said tray as it advances on said conveyor.

12. Apparatus according to claim 11 which further comprises web feed means for feeding a web of foil from a mandrel toward said sheet feed means, and shear means between said web feed means and said sheet feed means to shear off a sheet of foil of a length greater than the length of the said tray.

13. Apparatus according to claim 11 in which said sheet feed means comprises a pair of rollers turned in timed relation to movement of said conveyor.

14. Apparatus as in claim 1 in which said fifth means aligns precisely with said tray lip at said position 2 when said foil is being folded somewhat vertically downwards, and fifth means is first passing the tray.

15. Apparatus according to claim 1 in which said fifth means aligns precisely with the tray body under the lip when said fifth means is fully activated inwards and second means is at its lowest point of travel.

16. Apparatus according to claim 1 in which said fifth means is aligned precisely with said tray lip at position 8 when said fifth means is leaving the tray lip.

17. Apparatus for wrapping foil under the peripheral lip of a tray as said tray advances along a conveyor, comprising a plate formed with an aperture larger than said tray, mounting means for said plate and supporting said plate for movement from a first position above said tray and conveyor, then down to a second position, then to a third position beyond said second position, then to a fourth position with said lip within said aperture, then to a fifth position with cranks vertically downward, then to sixth, seventh, eighth and ninth positions at the same levels above said conveyor as said fourth, third, second and first positions respectively, and thence in a rotary path back to said first position, folding means on said plate and actuating means for actuating said folding means to move foil lying over said tray and hanging downward over said lip in-ward in timed relation to movement of said conveyor as said plate moves between second and third positions of said plate, said aperture being generally rectangular and said folding means being movable diagonally inward from each corner below said aperture, said folding means comprising horizontally disposed folder bars, positioned slightly below said plate, said actuating means comprising a crank connected to at least one of said bars and pivoted to said plates, a cam follower connected to said crank, and a cam stationary relative to said conveyor positioned to move said cam follower to cause said bar to move relative to said plate.

* * * * *